US005339793A

United States Patent [19]

Findley

[11] Patent Number: 5,339,793

[45] Date of Patent: Aug. 23, 1994

[54] BOW STABILIZER

[76] Inventor: Alan T. Findley, Rte. 5, Box 796 W, Marshall, Tex. 75670

[21] Appl. No.: 59,573

[22] Filed: May 13, 1993

[51] Int. Cl.[5] ..... F41B 5/00

[52] U.S. Cl. ..... 124/89; 188/379

[58] Field of Search ..... 124/89, 88; 188/379, 188/268

[56] References Cited

U.S. PATENT DOCUMENTS

| | | | |
|---|---|---|---|
| 4,570,608 | 2/1986 | Masterfield | 124/89 |
| 4,615,327 | 10/1986 | Saunders | 124/89 |
| 4,982,719 | 1/1991 | Haggard | 124/89 |

FOREIGN PATENT DOCUMENTS

| | | | |
|---|---|---|---|
| 2575817 | 7/1986 | France | 124/89 |

*Primary Examiner*—Randolph A. Reese
*Assistant Examiner*—Anthony Knight
*Attorney, Agent, or Firm*—John M. Harrison

[57] ABSTRACT

A stabilizer for dampening bow string and arrow release forces, which stabilizer includes, in a preferred embodiment, a cylindrical housing fitted with a pair of end caps, one of which end caps receives a threaded stud for mounting the housing on a bow. The opposite end cap is fitted with a tapped opening for mounting one of many accessory items which are well known to those skilled in the art. A flexible, pliant, deformable and resilient suppressor member is disposed inside the cylindrical housing and includes a bore for receiving a metal core. In one embodiment the suppressor member is pinched by means of retaining rings near each end of the core to maintain the core in a selected position. The core is therefore free to exhibit multidirectional movement and depress the resilient suppressor member in response to release of an arrow from the bow, to dampen the arrow release forces, bow string vibration and other forces acting on the bow.

9 Claims, 2 Drawing Sheets

BOW STABILIZER

BACKGROUND OF THE INVENTION

1. Field of the Invention

This invention relates to archery and more particularly, to a bow stabilizer which in a preferred embodiment is characterized by a cylindrical housing fitted with a pair of end caps, one of which receives a threaded stud for removably seating the housing in a threaded receptacle located in the bow frame. The opposite end cap may be fitted with a tapped opening for mounting one of many accessory items well known to those skilled in the art. A flexible, pliant, deformable, resilient suppressor is positioned inside the housing in a cylindrical "donut" configuration, defining a bore for receiving a metal core. In a preferred embodiment of the invention the core is positioned in the bore defined by the suppressor, spaced from the end caps by at least one, and more preferably, a pair of retaining rings which pinch the suppressor in spaced relationship to prevent the core from sliding inside the suppressor. Alternatively, the core may be encapsulated in the suppressor without the use of retaining rings. In both cases, because of the flexible, pliant, deformable and resilient "memory" of the suppressor, the core is able to move omnidirectionally within the suppressor bore or capsule. The core therefore reacts in an opposing manner to vibration and other forces created by release of the bow string and ejection of an arrow from the bow and resiliently deforms the suppressor to dampen the vibration and arrow-releasing forces.

Various types of bow stabilizers for increasing bow accuracy by reducing such detrimental factors as "bow slapping", vibration, "target panic", recoil, hand torque and shooter fatigue, in nonexclusive particular, are well known in the art. Many of these devices are hydraulic in design, wherein a central piston-like member reciprocates in a pool or bath of hydraulic oil or other viscous fluid within a housing to effect the desired dampening of bow string and arrow release vibration and forces acting on the bow when an arrow is released from the bow. A disadvantage of many of these devices is excessive weight, coupled with a variation in effectiveness to cause the desired dampening due to variations in temperature, which variation affects the viscosity of the fluid used as a dampening medium. Furthermore, these devices are not known for their silence and are frequently difficult to use effectively, especially in hunting situations, since the stabilizing noise tends to alert game in the area. Another disadvantage is the capability for limited dampening of multidirectional forces acting on the bow due to sliding movement of the piston-like members in a single plane only.

It is therefore an object of this invention to provide a new and improved bow stabilizer for mounting on a bow and dampening vibration, "bow slapping", recoil and other forces generated by release of the bow string and shooting an arrow from the bow.

Another object of the invention is to provide a new and improved bow stabilizer for mounting on the frame of a bow and dampening vibration and other multidirectional or omnidirectional forces generated when an arrow is released from the bow, by operation of a flexible, pliant, deformable and resilient suppressor located in a frame or housing, responsive to movement of a core member contacting or positioned within the suppressor.

A still further object of this invention is to provide a new and improved bow stabilizer for use on both recurve and compound bows, which bow stabilizer is characterized in a preferred embodiment by a cylindrical housing closed at both ends and adapted to mount on the frame of a bow and a resilient suppressor located in the housing and fitted with a bore for receiving a core member having substantial mass, such that the core member is prevented from sliding, but is able to deform the suppressor multidirectionally responsive to vibration and other forces generated when an arrow is released from the bow, to dampen these forces.

Yet another object of this invention is to provide a bow stabilizer for mounting on a bow and dampening forces generated when an arrow is released from the bow to tighten arrow groups and reduce hand torque, bow recoil and shooter fatigue, as well as "target panic", in non-exclusive particular, which bow stabilizer is characterized by a cylindrical housing having a pair of end caps threadably mounted thereon, one of which end caps is fitted with a threaded stud for mounting on the bow and a deformable, resilient suppressor located in the housing and encapsulating a metal core member, either with or without one or more retaining rings, to facilitate movement of the core member in an omnidirectional manner and resiliently deform the suppressor responsive to forces generated when an arrow is released from the bow, in order to dampen these forces.

SUMMARY OF THE INVENTION

These and other objects of the invention are provided in a new and improved bow stabilizer, which, in a preferred embodiment, is characterized by a cylindrical housing fitted with a pair of end caps, one of which receives a threaded stud for mounting the bow stabilizer on a bow and the other having a tapped opening for receiving an accessory item; a flexible, pliant, deformable and resilient suppressor provided in the housing; and a metal core encapsulated in the suppressor and optionally spaced from one or both of the end caps by means of one or a pair of retaining rings, respectively, for resiliently and multidirectionally deforming the suppressor and dampening and reducing forces generated by release of an arrow from the bow.

BRIEF DESCRIPTION OF THE DRAWING

The invention will be better understood by reference to the accompanying drawing, wherein.

DESCRIPTION OF THE PREFERRED EMBODIMENTS

Figure 1:
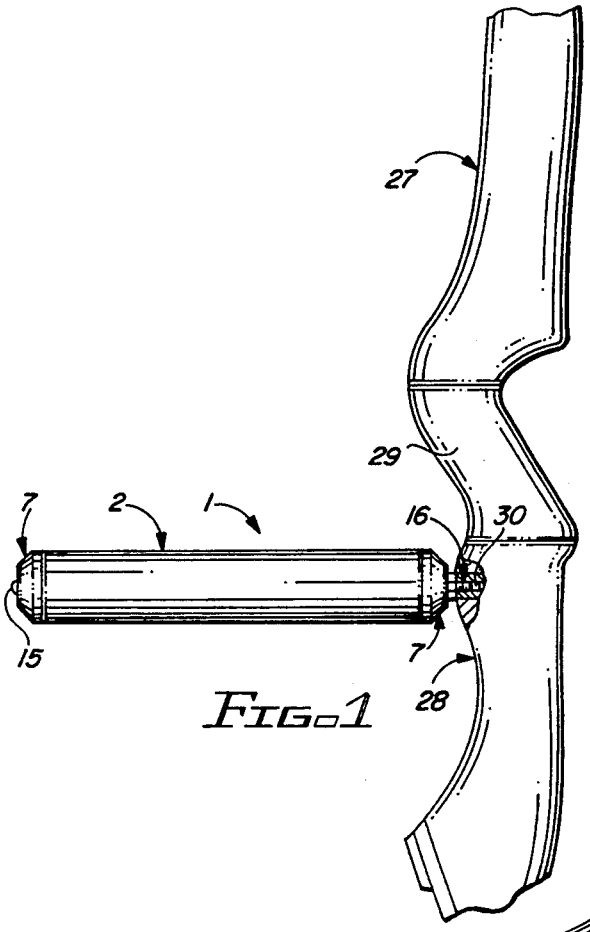
FIG. 1 is a side elevation of a preferred embodiment of the stabilizer of this invention mounted on a bow.
Figure 3:
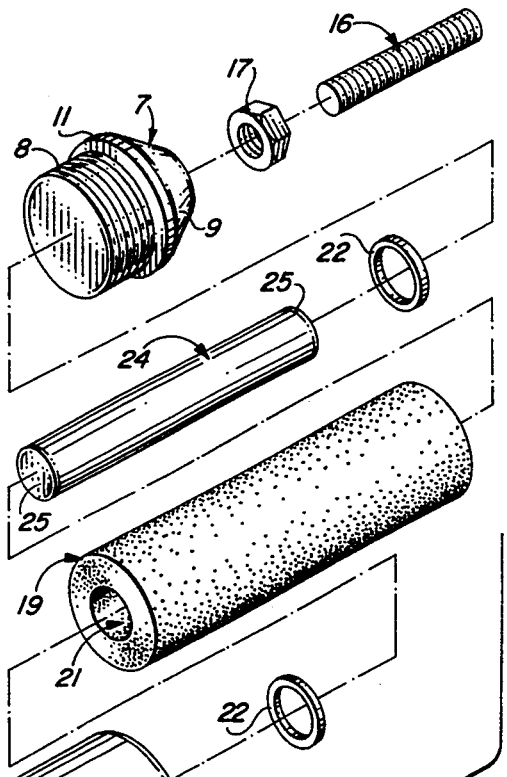
FIG. 3 is an exploded view of a first preferred embodiment of the bow stabilizer of this invention.
Figure 2:
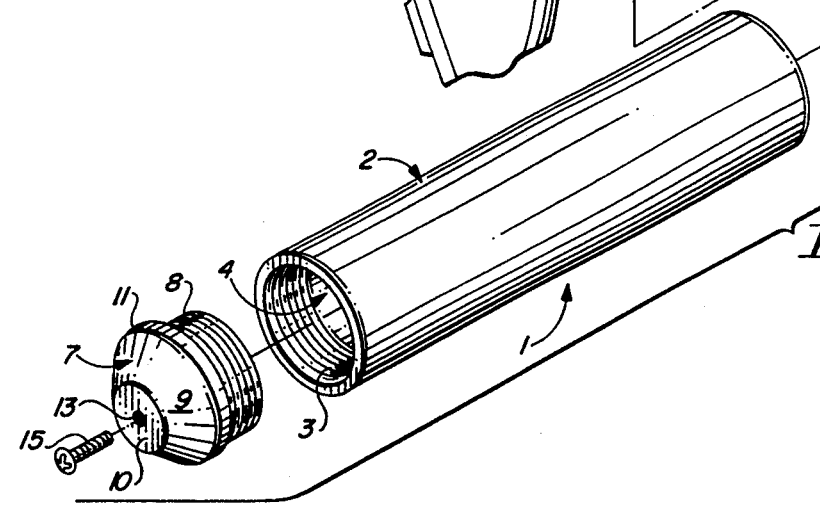
FIG. 2 is a longitudinal sectional view of the bow stabilizer illustrated in FIG. 1.
Figure 2:
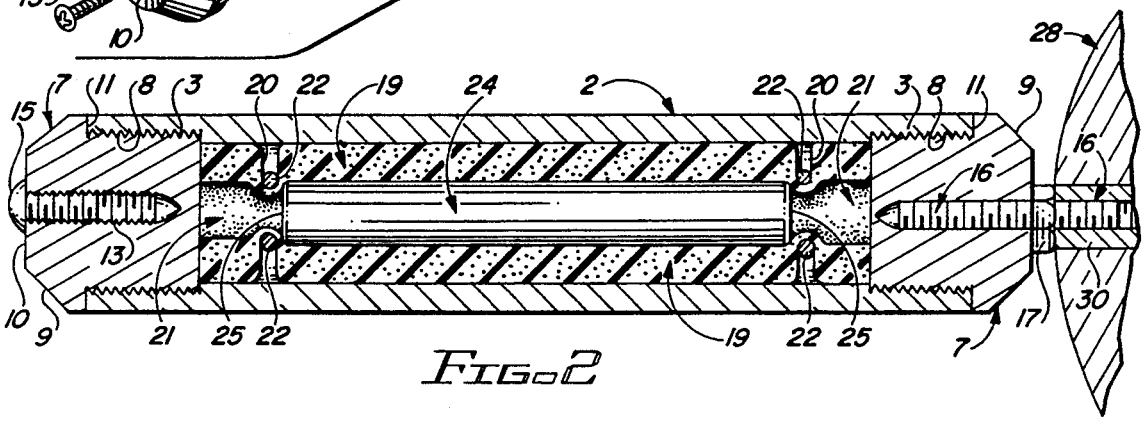

Referring initially to FIGS. 1–3 of the drawings, the bow stabilizer of this invention is generally illustrated by reference numeral 1. In a preferred embodiment the bow stabilizer 1 is characterized by a cylindrical housing 2, provided with internal housing threads 3 at each end and a central longitudinal housing bore 4. The housing bore 4 defines a housing inside wall B and pair of end caps 7 close each end of the housing 2 by threadable interaction between the external end cap threads B and the internal housing threads 3, respectively. Each of the end caps 7 is characterized by an end cap bevel 9, which terminates at an end cap face 10 and an end cap shoulder 11 is also defined at each of the end caps 7, as illustrated. An end cap tap 12, fitted with tap threads 13, serves to allow mounting of accessory items, such as spool for containing line for bow fishing, or other accessory items (not illustrated) which are well known to those skilled in the art. These accessory items are typically fitted with a threaded stud or bolt for engaging the tap threads 13 of the end cap tap 12 to facilitate removable attachment of the accessory to the end cap 7 which is fitted with the end cap tap 12. Under circumstances where no accessory item is included on the bow stabilizer 1, a button head bolt 15 may be threaded into the tap threads 13 of the end cap tap 12 to temporarily close the end cap tap 12. The opposite end cap 7 is provided with a threaded stud 16 and a jam nut 17, threaded on the threaded stud 16, which are used to securely, yet removably, threadably mount the bow stabilizer 1 in the internally threaded frame insert 30 seated in the bow frame 28 of a bow 27, below the grip 29, as illustrated in FIG. 1.

As illustrated in FIGS. 2 and 3, a suppressor 19, shaped in the form of a cylindrical donut, is characterized by a suppressor bore 21 which extends throughout the length of the suppressor 19, as illustrated. The suppressor 19 is constructed of a flexible, pliant, deformable and resilient material such as foam rubber, latex rubber or similar material known to those skilled in the art and an elongated metal core 24 is disposed within the supressor bore 21, between the suppressor pinches 20. The suppressor pinches 20 are created by spaced retaining rings 22, which are held in place at the core ends 25 by the resiliency of the suppressor 19 and serve to prevent the core 24 from sliding inside the suppressor bore 21. In a preferred embodiment of the invention the core 24 is characterized by any material having a density greater than the density of the suppressor 19, and most preferably, a metal such as steel, brass or the like, having a substantial mass which will substantially resiliently deform the suppressor 19 in dampening reaction and opposition to the forces created when an arrow is released from the bow, as hereinafter further described. It will be further appreciated by those skilled in the art that since the core 24 is substantially encapsulated inside the suppressor 19, it may resiliently deform the suppressor 19 omnidirectionally and is not limited to movement along its longitudinal plane. The core 24 is therefore free to react against and dampen substantially any force or forces which may be generated in any direction by release of the bow string and the arrow from the bow.

Figure 4:
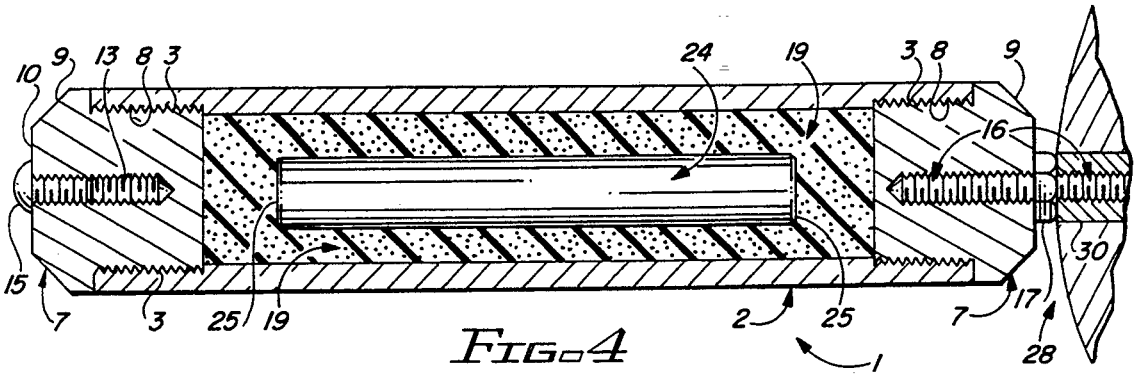
FIG. 4 is a longitudinal sectional view of a second preferred embodiment of the bow stabilizer of this invention.
Figure 5:
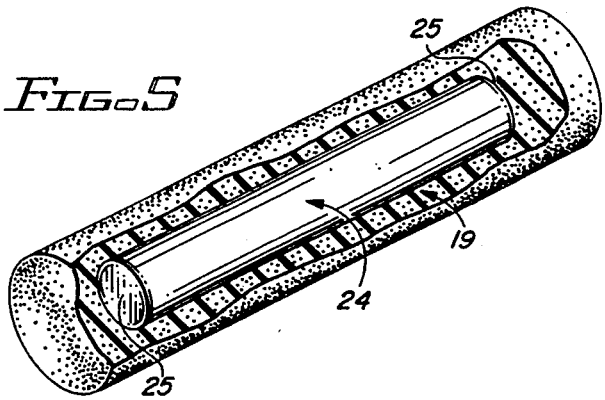
FIG. 5 is a perspective view, partially in section, of the bow stabilizer illustrated in FIG. 4.
Figure 6:
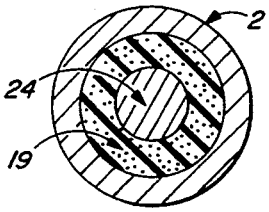
FIG. 6 is a sectional view, taken along line 6—6, of the bow stabilizer illustrated in FIG. 4.

Referring now to FIGS. 4–6 of the drawings, in another preferred embodiment of the invention the retaining rings 22 are absent and the suppressor 19 completely encapsulates the core 24, such that the core 24 may move omnidirectionally to dampen vibration and other forces acting on the bow 27 when an arrow is released from the bow 27. Accordingly, under the circumstances where the bow stabilizer 1 is characterized as illustrated in FIGS. 4–6, the bow stabilizer 1 is ultra-sensitive to even small vibrations and forces generated when the bow string is released and an arrow is shot from the bow 27.

Figure 7:
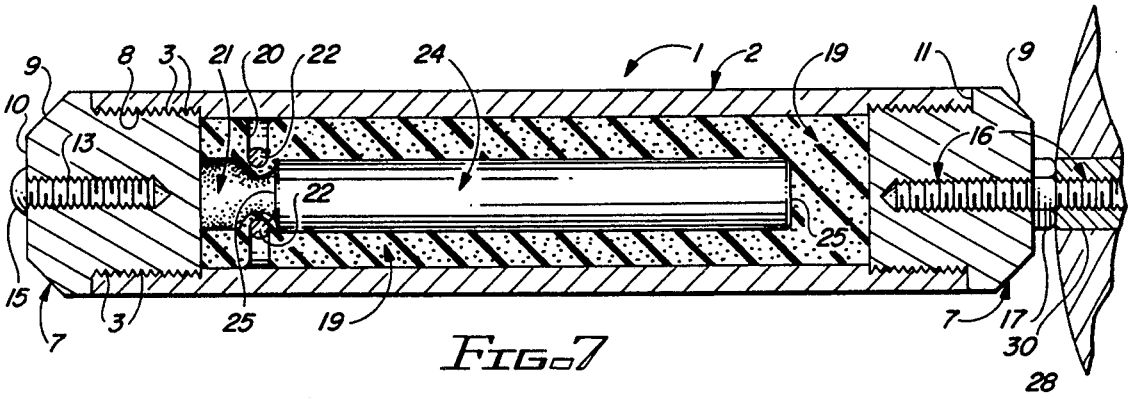
FIG. 7 is a longitudinal sectional view of a third preferred embodiment of the bow stabilizer of this invention.

As illustrated in FIG. 7 of the drawings, the sensitivity of the bow stabilizer 1 can also be adjusted by encapsulating one end of the core 24, while the opposite end of the core 24 is restrained from sliding in the suppressor bore 21 by means of a single suppressor pinch 21, shaped by a retaining ring 22 in the same manner as illustrated in FIGS. 2 and 3.

It will be appreciated by those skilled in the art that in each of the embodiments illustrated in the drawings, the bow stabilizer 1 can be "tuned" or designed for substantially any bow, whether recurve or compound in design, by selecting a suppressor 19 of suitable resiliency, flexibility and deformability and a core 24 of desired size, material, weight and density, to omnidirectionally dampen both the largest and smallest vibrations and forces generated when an arrow is released from the bow. Accordingly, the bow stabilizer 1 can be easily designed for use with light and heavy bows, as well as bows designed for target practice and hunting and including compound, cam-operated bows. Parameters in the design of the bow stabilizer 1 thus include the length and diameter of the housing 2 and the size and character of the suppressor 19 and core 24.

It will also be appreciated by those skilled in the art that since the bow stabilizer 1 of this invention does not depend upon temperature-sensitive fluids to create the dampening medium, the device is substantially unaffected by variations in temperature, humidity and other conditions under which a bow is operated. Accordingly, the bow stabilizer 1 is ideally suited for use on compound, recurve and other bows used for pleasure, match shooting and hunting purposes and has proved to be extremely quiet, since there are no moving parts other than resilient deflection of the suppressor 19 by the core 24 in a direction opposite to the forces applied to the bow frame by release of an arrow from the bow. Moreover, the bow stabilizer 1 is light in weight, since the housing 2 and end caps 7 are preferably constructed of aluminum or of a thermoplastic material such as polyethylene, polypropylene and the like, in non-exclusive particular. The core 24 most preferably has a weight in the range from about one ounce to about fifteen ounces, depending upon the size of the bow stabilizer 1 and the suppressor 19 is constructed of foam rubber or a material of equivalent resiliency having a density in the range of from about 0.05 to about 2.0 pounds per cubic foot and is therefore quite light in weight. In a most preferred embodiment of the invention the core 24 is cylindrical to provide optimum motion in deforming the suppressor 19 in any direction. However, other shapes such as a cube and the like can also be used for the core 24, as desired.

It will be further appreciated by those skilled in the art the bow stabilizer of this invention offers a new concept which compensates for bow energy and shooter hand torque, as well as arrow-release forces, to dampen these and other forces applied to a bow upon release of the drawstring and shooting an arrow from the bow. The bow stabilizer 1 is extremely quiet, can be used for tournament shooting, target shooting of all types as well as hunting and will reduce the effects of preload hand torque and unused energy from the limbs of a bow to prevent this energy from transmitting to the arrow, thereby allowing the arrow to fly more truly. Furthermore, the core 24 may be of any selected material, size and shape, as heretofore described, so long as its density extends the density of the suppressor 19, and the core 24 is able to move omnidirectionally left/right, up/down, forward/reverse, and even diagonally, to resiliently depress the suppressor 19 and accurately, efficiently and in an optimum manner, counteract the various forces applied to the bow when an arrow is released.

Although the bow stabilizer of this invention has been described with the particularity indicated above, it will be recognized and understood that various other modifications may be made in the invention and the appended claims are intended to cover all such modifications which may fall within the spirit and scope of the invention.

Having described my invention with the particularity set forth above, what is claimed is:

1. A stabilizer for dampening forces acting on a bow from release of an arrow from the bow, comprising a closed housing carried by the bow a single foam rubber suppressor disposed in said housing and an elongated core encapsulated in said suppressor, said core having a density greater than the density of said supressor whereby the forces acting on the bow in any direction are at least partially omnidirectionally dampened responsive to resilient deformation of said suppressor by said core in an opposite direction.

2. The stabilizer of claim 1 comprising mounting means carried by said stabilizer for engaging said housing and mounting said stabilizer on the bow.

3. The stabilizer of claim 1 comprising accessory mounting means carried by said stabilizer for mounting an accessory on said stabilizer.

4. The stabilizer of claim 1 comprising:

(a) threaded mounting means carried by said stabilizer for threadably engaging said housing and mounting said stabilizer on the bow; and (b) accessory mounting means carried by said stabilizer for mounting an accessory on said stabilizer.

5. The stabilizer of claim 1 comprising at least one retainer means engaging said suppressor at said core for limiting movement of said core with respect to said suppressor.

6. The stabilizer of claim 5 wherein said at least one retainer means comprises a pair of retainer means spaced on said suppressor, with said core disposed between said retainer means.

7. The stabilizer of claim 6 comprising a pair of end caps mounted on the ends of said housing for closing said ends of said housing and threaded mounting means provided in a first one of said end caps for threadably engaging said housing and mounting said stabilizer on the bow.

8. The stabilizer of claim 7 comprising threaded accessory mounting means provided in a second one of said end caps for threadably mounting an accessory on the stabilizer.

9. A stabilizer for counteracting forces acting on a bow from release of an arrow from the bow, comprising a closed cylindrical housing carried by the bow, a single deformable, pliant suppressor having a density in the range of from about .05 to about 2.0 pounds per cubic foot disposed in said housing and a single elongated core encapsulated in said suppressor, said core having a density greater than the density of said suppressor and a weight in the range of from about 1 to about 15 ounces, whereby the forces acting on the bow are at least partially omnidirectionally offset responsive to resilient deformation of said suppressor by said core.

* * * * *